US005992125A

United States Patent [19]

Hardy

[11] Patent Number: 5,992,125

[45] Date of Patent: Nov. 30, 1999

[54] TOP PLATE BRACE

[75] Inventor: Gary L. Hardy, Ventura, Calif.

[73] Assignee: Hardy Industries, Inc., Ventura, Calif.

[21] Appl. No.: 09/005,781

[22] Filed: Jan. 12, 1998

[51] Int. Cl.[6] ..... E04C 3/30

[52] U.S. Cl. ..... 52/737.3; 52/730.1; 52/731.1; 52/738.1

[58] Field of Search ..... 52/730.1, 730.7, 52/731.1, 712, 717.06, 736.3, 736.4, 737.3, 737.4, 737.5, 738.1, 739.1

[56] References Cited

U.S. PATENT DOCUMENTS

| | | | |
|---|---|---|---|
| 2,178,388 | 10/1939 | Beckman . | |
| 3,300,940 | 1/1967 | Golasz . | |
| 3,538,663 | 11/1970 | MacLeod . | |
| 3,538,664 | 11/1970 | MacLeod . | |
| 4,283,900 | 8/1981 | Schubert | 52/712 |
| 4,862,667 | 9/1989 | Melland | 52/732 |
| 5,678,381 | 10/1997 | DenAdel | 52/730.1 |
| 5,832,691 | 11/1998 | Callahan | 52/737.3 |

OTHER PUBLICATIONS

Simpson Strong–Tie Co. Catalog, Jan. 1, 1998, p. 64, Stud Shoes.

Harlen Metal Products, Inc. Catalog No. 993, 1993, p. 42, Stud Reinforcing Shoes (S90).

KC Metals Catalog, 1997/1998, p. 62, Stud Braces.

USP Kant–Sag—Silver Metal Connectors Full Line Catalog, Stud Shoes, STS Series.

*Primary Examiner*—Carl D. Friedman
*Assistant Examiner*—Yvonne Horton-Richardson
*Attorney, Agent, or Firm*—Lyon & Lyon LLP

[57] ABSTRACT

A brace structure includes a top plate of a wood-frame structure with a first plate vertically oriented on one side of the top plate and a second plate vertically oriented on the other side of the top plate. Two strips extend between the first edge and the second edge across the top plate. The strips include a space therebetween for passage of utility conduits. The plates have flanges for strength along the edges connecting the two strips. The plates also have fasteners therethrough and into the top plate.

13 Claims, 2 Drawing Sheets

TOP PLATE BRACE

BACKGROUND OF THE INVENTION

The field of the present invention is structural reinforcement in wood-frame buildings.

A need commonly exists to provide utilities, such as plumbing and electricity, to a wood-frame building. Often, main utility piping or wiring is routed into the attic or between floors of a building or other available space above an inhabited area. In order to route pipes and wiring from the attic or other upper space into a wall, a utility installer typically cuts or drills a hole in the portion of the wood-frame that forms the top of the wall—the pieces of lumber referred to as the top plate.

While this hole in the top plate is necessary to provide utilities to the structure, the hole also can significantly weaken or fully disrupt the top plate. As the hole increases in diameter, the strength of the top plate decreases and the shear strength of the entire structure may be adversely affected. Where cut completely, the top plate loses the ability to transfer force in tension or in sheer across the cut.

One of the ways in which low-level wood-frame structures are damaged and destroyed in earthquakes, tornadoes and hurricanes is through the failure of walls placed in shear under the load. Structural engineers often strengthen portions of the walls of such a structure to provide greater resistance to shear only at spaced locations. The shear forces on the wall are then transferred along the top plate to these strengthened portions. Typically, top plates run continuously across a wood-frame building in both directions so as to provide appropriate strength against shear. Failure of the top plate at any one point can defeat the transfer of shear forces such that the wall can fail in shear. A weakening of the top plate by either cutting or drilling through it for the passage of utilities, therefore, weakens the entire wall.

Heretofore, metal straps have been used which are placed to one or both sides of the top plate adjacent the hole or cut in recognition of the loss of structural integrity at such locations. Such metal straps typically act quite well in tension but provide little support in either compression or in shear. Another solution has been to bolt an angle iron to the inside of the top plate in these areas. The substantial extension of one of the flanges outwardly from the structure has a significant detrimental impact on the placement of wall board, other surface features and juxtaposed structural elements. The angle iron does contribute to strength in compression as well as tension.

SUMMARY OF THE INVENTION

The present invention provides a brace for a top plate in a wood-frame structure, with particular applicability to areas where the top plate has been cut or drilled through for utilities. A brace is contemplated which includes a first plate, a second plate and a plurality of strips which attach to the top edges of the two plates. This brace fits around a top plate in a wood-frame structure and fastens thereto for reinforcement. The plates are preferably strengthened in compression through inwardly extending flanges. The strips extending between the plates may also be configured so as to both allow adequate access between strips for utilities and yet fit between adjacent studs placed on 16" centers.

Accordingly, it is an object of the present invention to provide an effective apparatus for bracing the top plate or beam in a wood-frame structure subjected to shear loads where that top plate or beam is cut or penetrated by a hole. Other and further objects and advantages will appear hereinafter.

DETAILED DESCRIPTION OF THE PREFERRED EMBODIMENTS

Figure 1:
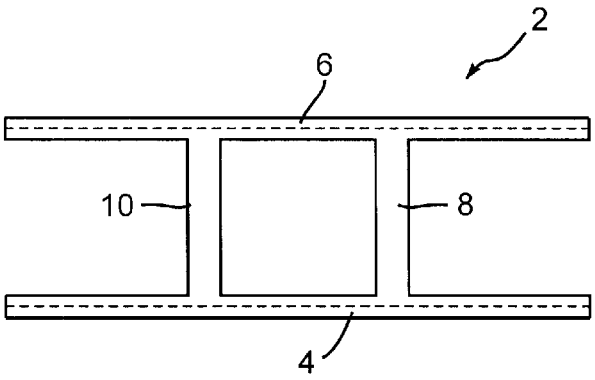
FIG. 1 is a top view of the shear brace.

Referring to FIG. 1 of the accompanying drawings, a brace 2 is illustrated for use with a top plate in wood-frame construction. The top plate is typically a composite of two 2"×4"s or two 2"×6"s with one on top of the other and each oriented with the longer dimension extending horizontally. The brace 2 consists of a first plate 4, a second plate 6, a first strip 8, and a second strip 10. The first plate 4, the second plate 6, the first strip 8, and the second strip 10 are preferably all stamped as a whole from a single piece of sheet metal and formed into the brace 2. The plates 4 and 6 are parallel and spaced to accommodate one or the other of the standard widths. With a top plate of 2"×4s for example, the i.d. of the brace 2 between plates 4 and 6 is 3⅝". The open space between the first strip 8 and the second strip 10 allows for the pass through of utilities such as pipes and wires.

Preferably the two strips 8 and 10 are the only strips connecting the two plates 4 and 6. However, a single strip may be used or more than two. Multiple strips provide increased relative positional stability between the two plates 4 and 6. Further, a broader base for resting on the top plate is possible which can aid in alignment on the frame structure. Preferably the strips are at least about three inches apart to allow for utility routing through the hole or the cut between strips. It is also advantageous to keep the strips close enough together so that they can fit between studs placed on 16" centers. A maximum width is, therefore, preferably 14½ inches. With a 24" long brace, a preferred construction is to have 1½" strips 8 and 10 with a dimension from the outside of one strip to the outside of the other strip of 14 inches. The strips 8 and 10 need not have straight parallel sides. they may, for example, form circular or oblong holes therebetween by curving the inner sides of each strip.

Figure 2:
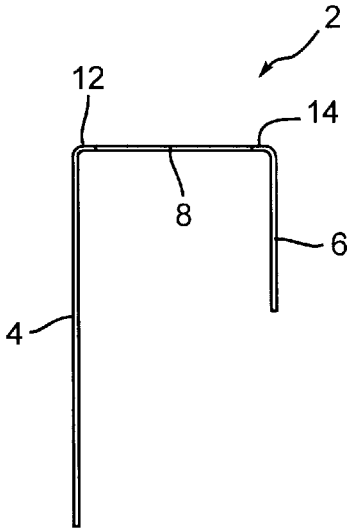
FIG. 2 is a side view of the shear brace.

FIG. 2 shows a side view of the brace 2. The first plate 4 is substantially flat along the majority of its vertical length and may be about 24"×3". The top edge of the first plate 4 bends inward toward the second plate 6 at substantially a ninety-degree angle, such that the top edge of the front plate 4 forms a flange 12 about ¼" o.d. wide which rests on top of the top plate or beam. Similarly, the second plate 6 is substantially flat along the majority of its vertical length and is about 24"×1½". The top edge of the second plate 6 bends inward toward the first plate 4 at substantially a ninety-degree angle such that the top edge forms a flange 14 also about ¼" o.d. wide which rests on the top of the top plate or beam.

The flanges 12 and 14 contribute to the column strength of the plates 4 and 6. Even so, their extension is designed to minimize interference with studs, trusses or the like which are also associated with the top plate. At the same time, by extending inwardly, there is less likelihood of interference with drywall or other surface treatment.

Preferably, the first plate 4 is longer in the vertical dimension than the second plate 6, as seen in FIG. 2, but the first plate 4 may possess an equal or lesser vertical dimension than the second plate 6. The first plate 4 is installed facing the outside of a wooden structure, and the second plate 6 is installed facing the inside. The shorter vertical dimension of the second plate 6 generally prevents it from protruding in the vertical dimension below the bottom of the wooden top plate or beam on which the brace 2 is installed. Consequently, the brace 2 does not significantly affect the finishing of interior walls. For example, drywall may be hung in the same manner as if the brace 2 were not installed. The larger vertical dimension of the first plate 2 gives it additional size, enabling it to provide added reinforcement against shear forces on the structure.

Figure 3:
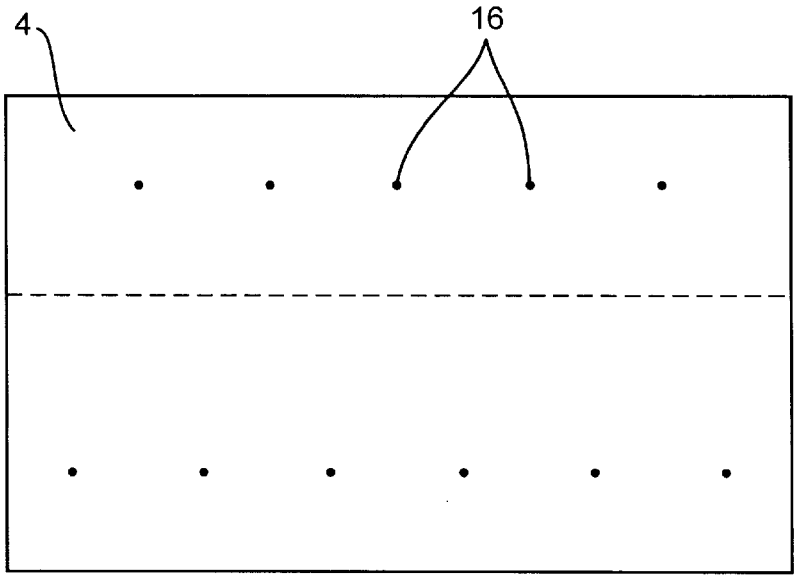
FIG. 3 is a front view of the shear brace.

FIG. 3 shows the front view of the brace 2, which consists of the first panel 4. Preferably, several fastener holes 16 are drilled in the first panel 4 in a staggered pattern, facilitating attachment of the shear brace 2 to the top plate 18 by ¼" screws. The second plate 6 also has holes for $16^d$ nails. The strips 8 and 10 have two holes each for $16^d$ nails.

Figure 4:
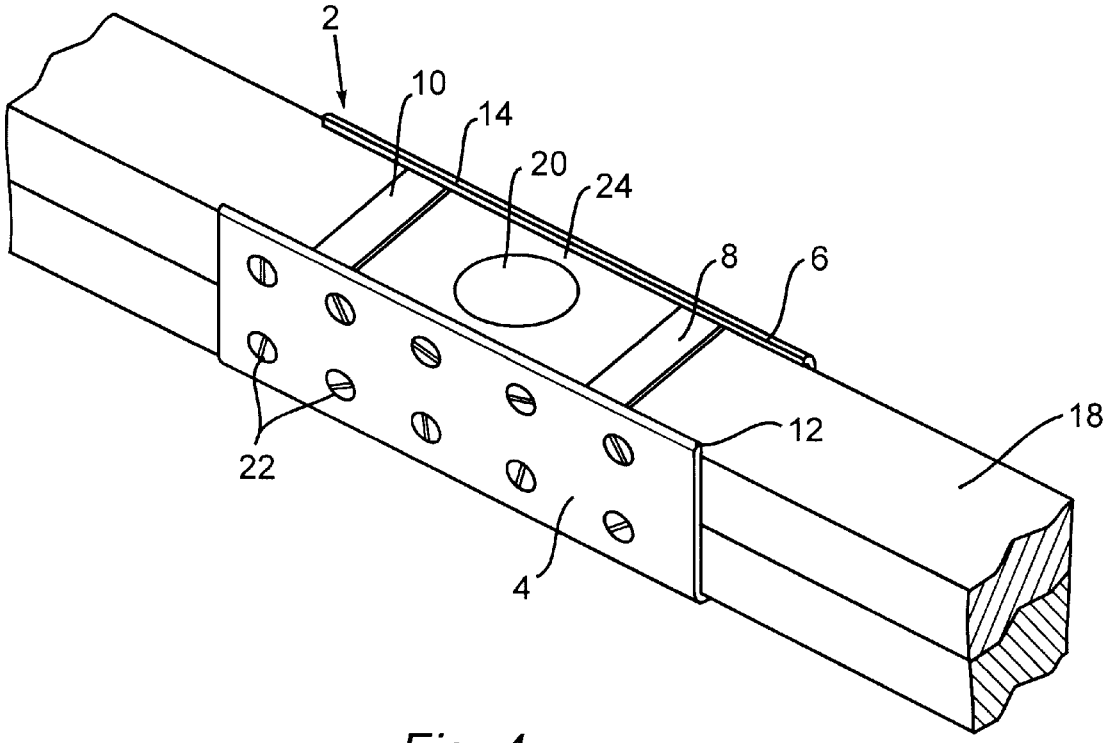
FIG. 4 is a perspective drawing of the installed shear brace on a wooden top plate.

FIG. 4 shows the shear brace 2 attached to a top plate 18 with ¼" screws 22. The top plate 18 contains a utility access hole 20, drilled through the top plate 18 to enable passage of utilities such as pipes and wires through it. It can be seen in FIG. 4 that the first plate 4 and second plate 6 are substantially flat and fit snugly against the sides of the top plate 18. Similarly, the first strip 8 and the second strip 10 are substantially flat and fit snugly against the top or bottom of the top plate 18.

Severe shear loads, as exerted on the structure during an earthquake, tornado, or hurricane, are transferred along the length of the top plate 18. Consequently, those resulting loads are most concentrated at two potential failure points 24 on either side of the utility access hole 16, where the cross-sectional area of the top plate 18 is the smallest. The brace 2 reinforces the top plate 18 by carrying a large portion of those loads which may be in tension, compression and/or shear. The brace 2 is attached to the top plate 18 by the fasteners 22. Those fasteners 22 create a load path from the top plate 18 through the fasteners, screws or nails 22, on one side of the utility access hole 20 and into the brace 2, then back through the fasteners 22 on the other side of the access hole 20 and back into the top plate 18. The brace 2 reinforces the top plate 18 in both tension and compression.

A preferred brace and many of its attendant advantages have thus been disclosed. It will be apparent, however, that various changes may be made in the form, construction, and arrangement of the parts without departing from the spirit and scope of the invention, the form hereinbefore described being merely a preferred or exemplary embodiment thereof. Therefore, the invention is not to be restricted or limited except in accordance with the following claims.

What is claimed is:

1. A brace for a structural top plate comprising a first structural plate having a first edge including a first flange extending normal to the first plate;

a second structural plate disposed in parallel with the first structural plate and having a second edge parallel to the first edge and including a second flange extending normal to the second structural plate, the first and second flanges extending toward one another, the dimension of the first structural plate perpendicular to the first edge being greater than the dimension of the second structural plate perpendicular to the second edge;

strips extending between the first flange and the second flange, the strips being normal to the first structural plate and the second structural plate, the first structural plate and second structural plate being connected to each other solely by the strips.

2. The brace of claim 1, the first and second plates each having a plurality of fastening holes.

3. The brace of claim 1, the first and second plates being formed from a single piece of material with the strips.

4. The brace of claim 1, the flanges having a width of ¼" o.d.

5. A brace structure comprising a top plate of a wood-frame structure defining a utility access hole therethrough;

a first structural plate vertically oriented on one side of the top plate and having a first edge;

a second structural plate vertically oriented on the other side of the top plate and in parallel with the first plate and having a second edge parallel to the first edge;

two strips extending between the first edge and the second edge across the top plate, the strips being normal to the first structural plate and the second structural plate and including a space therebetween that allows access to the utility access hole through the brace for utility conduits, the first plate and second plate being connected to each other solely by the strips; and a plurality of fasteners extending through the first plate into the top plate and a plurality of fasteners extending through the second plate into the top plate.

6. The brace structure of claim 5, the first and second plates each having a plurality of fastening holes.

7. The brace structure of claim 5, the dimension of the first structural plate perpendicular to the first edge being greater than the dimension of the second structural plate perpendicular to the second edge.

8. The brace structure of claim 5 further comprising screw fasteners extending through the plurality of fastening holes in the first plate and into the top plate.

9. The brace structure of claim 5, the first edge including a first flange extending normal to the first structural plate and toward the second structural plate with about a ¼" o.d. and the second edge including a second flange extending normal to the second structural plate and toward the first structural plate with about a ¼" o.d., the strips extending between the first and second flanges.

10. A structural brace for a beam that carries structural loads around a utility access hole defined within the beam, comprising:

a first structural plate adapted to be in substantial contact with one side of the beam;

a second structural plate adapted to be in substantial contact with the opposite side of the beam;

a plurality of fasteners for connecting the first plate to the beam and a plurality of fasteners connecting for the second plate to the beam, the fasteners carrying structural loads between the brace and the beam such that the brace carries a portion of the structural loads around the utility access hole; and a plurality of strips connecting the first plate to the second plate, two of the strips defining therebetween a space allowing access to the utility access hole.

11. A brace for a structural top plate comprising a first structural plate having a first edge;

a second structural plate disposed in parallel with the first plate and having a second edge parallel to the first edge, wherein the first structural plate has a first opposite edge opposite from the first edge, the first opposite edge spaced apart from the second structural plate to receive a structural top plate, and strips extending between the first edge and the second edge, the strips being normal to the first structural plate and the second structural plate, the first structural plate, the second structural plate and the strips forming a U-shaped brace in cross section.

12. The brace of claim 11, the first edge including a first flange extending normal to the first structural plate and toward the second structural plate, the strips extending from the first flange.

13. The brace of claim 11, the second edge including a second flange extending normal to the second structural plate and toward the first structural plate, the strips extending from the second flange in substantially the same plane as the second flange.

* * * * *